US007832667B2

(12) United States Patent
Doppstadt et al.

(10) Patent No.: US 7,832,667 B2
(45) Date of Patent: Nov. 16, 2010

(54) COMMINUTION DEVICE

(75) Inventors: Johann Doppstadt, Velbert (DE); Horst Berger, Calbe/Saale (DE)

(73) Assignee: Doppstadt Calbe GmbH, Calbe (DE)

( * ) Notice: Subject to any disclaimer, the term of this patent is extended or adjusted under 35 U.S.C. 154(b) by 48 days.

(21) Appl. No.: 11/920,143

(22) PCT Filed: May 18, 2006

(86) PCT No.: PCT/EP2006/004739

§ 371 (c)(1),
(2), (4) Date: Nov. 9, 2007

(87) PCT Pub. No.: WO2006/122814

PCT Pub. Date: Nov. 23, 2006

(65) Prior Publication Data

US 2009/0065619 A1 Mar. 12, 2009

(30) Foreign Application Priority Data

May 19, 2005 (DE) ..... 20 2005 008 077 U

(51) Int. Cl.
*B02C 18/16* (2006.01)

(52) U.S. Cl. ..... 241/73; 241/243; 241/285.2

(58) Field of Classification Search ..... 241/73, 241/189.1, 285.2, 285.3, 87, 243
See application file for complete search history.

(56) References Cited

U.S. PATENT DOCUMENTS

| | | | | |
|---|---|---|---|---|
| 5,199,666 | A * | 4/1993 | Williams | 241/73 |
| 5,611,495 | A * | 3/1997 | Williams | 241/73 |
| 6,330,982 | B1 | 12/2001 | Yu et al. | |
| 6,910,647 | B2 * | 6/2005 | Alford et al. | 241/73 |

FOREIGN PATENT DOCUMENTS

| | | |
|---|---|---|
| DE | 195 20 982 | 12/1995 |
| DE | 295 010 67 | 7/1996 |
| DE | 195 47 828 | 6/1997 |
| DE | 203 01 354 | 7/2004 |
| EP | 1 442 796 | 8/2004 |
| GB | 2 344 060 | 5/2000 |

OTHER PUBLICATIONS

German Search Report dated Mar. 8, 2007.
International Search Report dated Sep. 25, 2006.

* cited by examiner

*Primary Examiner*—Mark Rosenbaum
(74) *Attorney, Agent, or Firm*—Jacobson Holman PLLC

(57) ABSTRACT

A shredding device, consisting of at least one shredding roll that is rotatably mounted in a machine frame, at least one shredding instrument that is mounted on the roll, at least one opposing blade that co-operates with the shredding instrument(s) and at least one screen for the shredded product. The housing of the screen at least partially surrounding the shredding roll. The screen can be displaced in relation to the machine frame and/or the shredding roll.

16 Claims, 2 Drawing Sheets

COMMINUTION DEVICE

Figure 1:
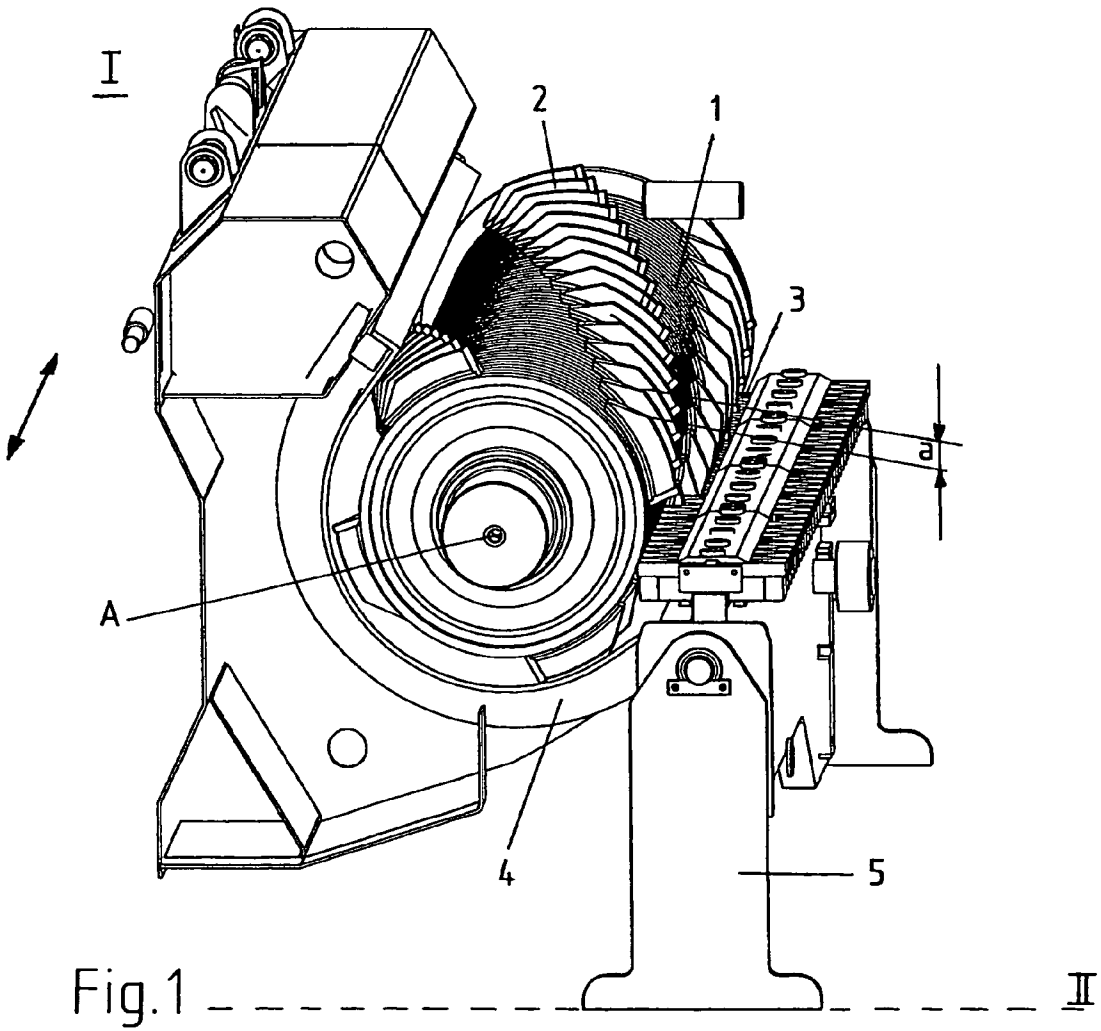

This is a national stage of PCT/EP06/004739 filed May 18, 2006 and published in German.

The invention refers to a comminution device for comminuting different materials.

Comminution devices of this kind are known in different embodiments. They consist of at least one comminution cylinder supported rotatably in a machine frame with at least one comminution tool arranged on it, and at least one counter blade interacting with the comminution tool. Furthermore, the known comminution devices have at least one sieve device for the comminuted material the housing of which embraces the comminution cylinder at least partly. Embracing the housing by the sieve device is necessary so that the comminuted material can be collected completely.

The comminution cylinder has, as a rule, a number of comminution tools which interact with a corresponding number of counter blades. The sieve device embraces here the complete length of the comminution cylinder in order to be able to collect all of the comminuted material. The problem is now that in the continuous operation chokings will occur in the sieve device by the comminuted material which, as a rule, only can be removed by stopping the machine and cleaning it. This, of course, obstructs a continuous comminution process so that by stopping the comminution device as well as by the subsequently necessary cleaning operations considerable expenses will occur for the operator of such comminution devices.

Coming from the state of the art described before it is an object of the invention to develop a comminution device which does not have anymore the disadvantages known from the state of the art.

The problem of the invention is solved by a comminution device comprising at least one comminution cylinder supported rotatably in a machine frame with at least one comminution tool arranged on it, and with at least one counter blade interacting with the comminution tool, and with at least one sieve device for comminuted material the housing of which embraces the comminution cylinder at least partly, which is characterised in that the sieve device is arranged movably relatively to the machine frame and/or the comminution cylinder. The movable arrangement of the sieve device to the comminution cylinder causes the sieve device in the comminution process to move back and forth in the direction of the axis of the comminution cylinder and thus a cleaning effect occurs. The sieve device is here not always only below the same point of the comminution cylinder or the counter blade so that the produced comminuted material can be spread better. By means of the relative movement simultaneously a better removal of the comminuted material out of the sieve device is caused which has other positive effects.

By means of the embodiment of the sieve device according to the invention, namely its relative mobility with regard to the machine frame or with regard to the comminution cylinder it is now possible that the disadvantages from the state of the art have been removed entirely. The no-load times or the stand-still times of the comminution devices now are reduced to a minimum, that means to the usual maintenance times, and the rather time-consuming and disagreeable cleaning works during the comminution operations are completely deleted.

According to an advantageous development of the invention it is provided that the relative movement for the sieve device is provided parallel to the axis of the comminution cylinder. This relative movement is characterised by a relatively simple realisation. Because of the embodiment of this machines this can be constructed best. The relative movement is here caused in the machine frame directly, and is thus provided as a so-called oscillating movement or movement back and forth with regard to the cylinder. It is, of course, also possible that the machine frame is designed inclusively the sieve device relatively movably to the cylinder. It is, in constructive respect, no problem, either, to have the cylinders oscillating back and forth in the way of an oscillating movement. Such an embodiment is also comprised by the suggestion according to the invention.

Another aspect of the invention is given by the fact that the sieve device has openings which serve for fractionating the comminuted material, and which are arranged facing the collection side. By this design of the sieve device according to the invention it is, on the one hand, guaranteed that only comminuted material according to a provided fractionating gets in the sieve device for removing, and, on the other hand, that just not comminuted material remains still in the comminution area between cylinder and counter blade, and is processed accordingly once again. Also by this combination of the sieve device with the corresponding openings with the relative movement with regard to the machine frame or the comminution cylinder it is now possible to use also appropriate sieves which just because of the relative movement do not choke so fast, and run through a permanent auto-cleaning process.

The sieve device is, according to an convenient development of the invention designed like a basket, that means it embraces the comminution cylinder like a basket at least in a region which comprises half or more than half of the comminution cylinder at the exterior diameter. This basket-like design has several advantages. One consequence is that certain regions of the comminution cylinder can be visually inspected even without dismounting the basket. Also certain service works, for example exchanging the comminuting knives, can be carried out without dismounting the sieve device.

A development of the before described embodiment of the invention suggests that the sieve device is arranged in such a way that it can be turned away from the comminution cylinder or towards the comminution cylinder. In combination with a basket-like design, for example, the sieve device can now be turned away. This may be used very well for servicing and cleaning, for example when the product of the comminuted material changes, as the access to the sieve device now is improved essentially. The comminution cylinder also can be accessed better for certain maintenance and cleaning tasks so that the mentioned tasks can be realised much faster and thus more economically. Also a change of the side of the sieve device which points to the collection side is possible, if, for example, an altered fractionating for the comminuted material is desired. For this purpose as well it is, of course convenient if the sieve device is turned away from the comminution cylinder as then the exchange of the sieve of the sieve device is carried out, and, after finishing these works, the sieve device is turned again into its working position.

A development of the invention provides that the width or size of the openings of the sieve device can change. It is, of course, also possible to arrange suitable grids or sieves on the side of the sieve device facing the collection side which then can be exchanged in order to change their size or to change the fractionating. The invention comprises both modifications. Even thus a higher versatility of the comminution device according to the invention is reached.

According to the invention it has also turned out to be an advantage when the device has two comminution cylinders which, in particular, counter rotate. It is then, of course, provided that both cylinders are embraced by a sieve device preferably also basket-like. As the cylinders are arranged counter-rotating it is now possible to arrange a two-sided counter blade in the center of the machine which has further advantages. These advantages are useful for maintenance as well as also with regard to the comminution effect. As the sieve devices are designed also in the modification according to the invention with two cylinders in such a way that they can be turned away here also a convenient maintenance or change service is possible. Furthermore by means of the central support of the counter blade this may be arranged in such a way that the result is a very advantageous adjustment of the counter blade to the knife. If necessary, the counter blade can also be arranged on a suitably height adjustable fastening device. The advantages described before are also reached with the embodiment with two comminution cylinders.

Therefore the comminution device according to the invention has, according to another modification of the invention, a counter knife which has blades on both sides each of which interact with comminution tools of the comminution cylinder facing the blade. This effect has already been described in the previous embodiment of the invention.

By means of the modifications of the invention described before it is also possible to design the counter knife conveniently height adjustably. Of course, this embodiment can also be realised in the modification with only one comminution cylinder. The invention is not limited to a solution consisting of two comminution cylinders with one counter knife and blades on both sides.

It is also possible, according to the invention, in the embodiment with two comminution cylinders to provide either only one sieve device or for each comminution cylinder its own sieve device. The modification with one sieve device for each comminution cylinder is varied here, according to another embodiment of the invention.

According to the invention one drive each is also provided for comminution cylinder and sieve device, preferably for all comminution cylinders and sieve devices. It is an advantage here if the comminution cylinder has, for example, an electric drive. For the sieve device it has turned out to be convenient if, according to another modification of the invention, a hydraulic drive is provided for the sieve device or the sieve devices.

According to the invention it has also been found to be an advantage if the length or the dimension of the relative movement of the sieve device can alter, and corresponds at least with the distance by which the comminution tools are arranged on the comminution cylinder. This guarantees that by means of the relative movement of the sieve device all parts of the sieve device facing the cylinder run always such that they run through all regions in the same way with regard to the elevations and indentations of the cylinder. Thus an excellent cleaning and sieving effect is reached. The risk of choking is almost completely removed by means of that. Of course, the invention also comprises embodiments where the relative movement with regard to the distance of the comminution tools on the comminution cylinder becomes larger or smaller.

According to an embodiment the invention is also characterised in that the position of the comminution cylinders in the device is orientated essentially horizontally. This does not exclude that the comminution cylinders are inclined at a certain angle which, for example, improves removing of the comminuted material. According to that then also the sieve devices are arranged correspondingly. They embrace here the comminution cylinder at least half with regard to the diameter. It is, however, in particular given that, according to an advantageous embodiment of the invention the sieve device embraces the comminution cylinder in the bottom region seen in installation direction.

It is an advantage here if the sieve device embraces the comminution cylinder, seen in a section, by about 45% to 60%.

According to the invention it has also been found to be convenient if the bottom end of the sieve device and the top section of it form an angle of 40° to 60° with regard to the installation plane of the device. Thus optimal results for sieving and collection for the comminuted material can be realised. Of course, the invention also refers to a sieve device itself which can be, for example, retrofitted accordingly with certain comminution devices. The sieve device refers here to all embodiments which have been described before for the comminution device.

Figure 2:
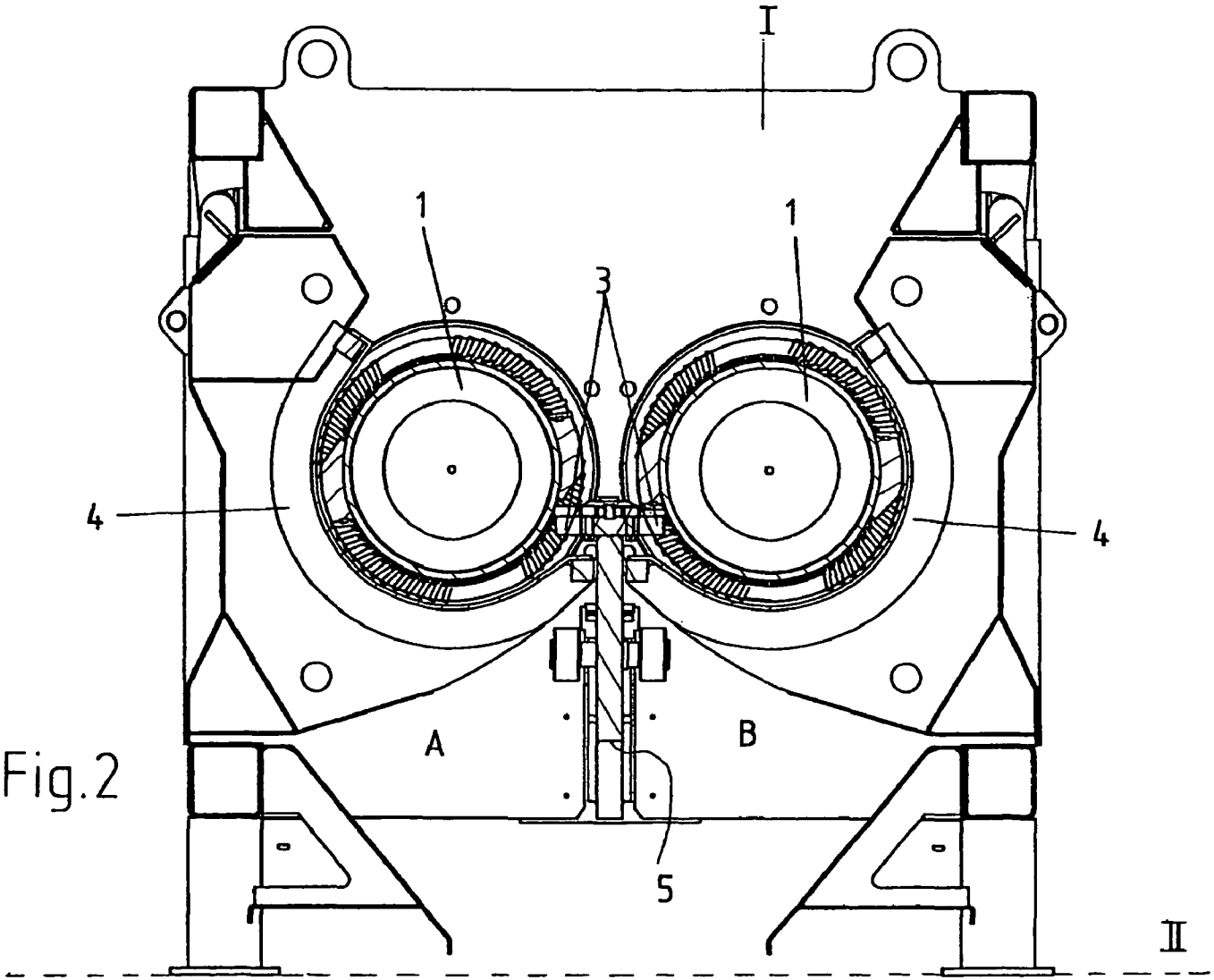

The invention is illustrated further in the following by means of examples. In the figures:

FIG. 1 a three-dimensional view of an embodiment of the sieve device according to the invention, and FIG. 2 another embodiment of the invention with two comminution cylinders.

FIG. 1 shows a three-dimensional view of a first embodiment of the comminution device according to the invention. Reference number 1 indicates here the comminution cylinder, which is supported rotatably in a machine frame I. On the comminution cylinder 1 comminution tools 2 are arranged spirally. The comminution tools 2 are formed here by a knife carrier which is provided at the circumference of the comminution cylinder 1. The knife carriers themselves carry at their sides orientated in the cutting direction the comminution knives. The comminution tools 2 interact with a counter blade 3 which is arranged on a portal or a frame, respectively. The counter blade 3 has here a number of blades which are arranged correspondingly to the comminution tools, and which interact with the comminution knives of the comminution tools 2. When set at a certain distance the material which has to be comminuted is transported from the comminution cylinder towards the counter blade, and is there comminuted by the comminution tools in interaction with the counter blade. The comminuted material is collected in the sieve device 4 which is arranged basket-like around the comminution cylinder 1. The sieve device 4 embraces here about 60% of the circumference of the comminution cylinder 1. On the side of the sieve device 4 facing the comminution cylinder 1 (that is facing the interior of the device) openings are provided which serve for fractionating the comminuted material. These openings are not shown for simplicity reasons.

According to the different modifications as they have been described in the previous description it is possible to design these openings in such a way that they can be exchanged or their size can be changed. A double arrow in the upper part of FIG. 1 indicates that the sieve device can be moved parallel relatively to the axis A of the comminution cylinder 1. This movement is provided as oscillating movement or movement back and forth. Here different modifications can be realised according to the invention. It is, for example, possible to design the machine frame I or a part of the machine frame I movably so that a relative movement of machine frame inclusively the sieve device occurs with regard to the comminution cylinder. It is, however, also possible to arrange the sieve device itself in the machine frame I movably so that also a relative movement is caused between the machine frame I and the sieve device as well as between the sieve device and the comminution cylinder 1. In this respect the invention is designed here for different modifications. The machine frame I is only indicated schematically in FIG. 1.

In the view according to FIG. 1 it can also be discerned that the sieve device 4 is designed in such a way that it can be turned away from the comminution cylinder 1. Furthermore, in FIG. 1 the distance a is given which is the distance of the single comminution tools 2 to one another on the comminution cylinder 1. For the comminution procedure the comminution cylinder 1 is caused to rotate. This rotational movement is provided in the shown modification in clockwise direction as the blades are arranged accordingly on the comminution tools. These comminution tools interact, as already described, with the counter blade 3 so that the material to be comminuted is comminuted accordingly. The material comminuted to the proper size then gets in the sieve device if it gets through the openings provided there in the body of the sieve device. Not yet sufficiently comminuted material gets, through the rotational movement, again in the region between the comminution tool and the counter blade, and is then comminuted one more time so that it corresponds also with the suitable fractionating and can get in the sieve device. Conveniently the sieve device is arranged analogously to the design of the cylinder wherein a small inclination is an advantage so that the material to be comminuted can also be removed at the same time conveniently. The comminuted material gets from the sieve device then, for example, to a suitable conveying device which conveys away the comminuted material. However, this is not essential for the invention and thus not shown.

FIG. 2 shows an embodiment of the solution according to the invention where two comminution cylinders 1 are provided. Both comminution cylinders 1 are embraced by the sieve devices 4. In the center of the comminution device there is the counter blade 3 with a multitude of blades which interact with the comminution tools 2 which are only indicated schematically. The axes of the comminution cylinders 1 are indicated with A and B. The installation plane for the device is indicated with reference number 11. The machine frame, on the other hand, has reference number 1. Reference number 5 indicates the frame for the counter blade which may be designed, for example, like a portal. This frame is, in particular, designed height adjustably. Also in the view of FIG. 2 it can be seen clearly that the sieve device 4 is designed in such a way that they can be turned away from the comminution cylinders 1 either to the left or the right. This improves the service friendliness, and may be very convenient, for example, for the change of the sieves or for necessary cleaning when the material to be comminuted changes.

The invention has been described before by examples. However, the invention is not limited to it. The claims filed now and with the application later on are attempted formulations without prejudice for obtaining a broader protection.

References in the sub-claims relate to the further design of the matter of the main claim through the characteristics of the respective sub-claim. These are, however, not to be understood as a waiver of independent protection for the characteristics of the referred sub-claims.

Characteristics only disclosed in the description so far may, in the course of proceedings, be claimed as being of inventive relevance, for example to distinguish from the state of the art.

The invention claimed is:

1. Comminution device comprising at least one comminution cylinder supported rotatably in a machine frame with at least one comminution tool arranged on the at least one comminution cylinder, at least one counter blade interacting with the comminution tool, and at least one sieve device for the comminuted material the housing of which embraces at least partly the comminution cylinder, the sieve device reciprocating back and forth with respect to at least one of the machine frame and the comminution cylinder in a direction of an axis of the comminution cylinder during a comminution process, the sieve device being turned away from the comminution cylinder or towards the comminution cylinder while the sieve device is attached to the machine frame for accessing and cleaning the comminution cylinder.

2. The comminution device according to claim 1, wherein the sieve device has openings which serve for fractionating the comminuted material and are arranged facing a collection side.

3. The comminution device according to claim 1, wherein the sieve device is in a basket shape.

4. The comminution device according to claim 1, wherein openings in the sieve are provided and a width or size of the openings of the sieve device vary.

5. The comminution device according to claim 1, further comprising two comminution cylinders which counter rotate.

6. The comminution device according to claim 1, wherein counter knives are provided and the counter knives have blades on both sides each of which interacting with the comminution tools of the comminution cylinder facing the blade.

7. The comminution device according to claim 1, wherein counter knives are provided and the counter knife is designed height adjustably.

8. The comminution device according to claim 1, wherein for each comminution cylinder one sieve device is provided.

9. The comminution device according to claim 1, wherein one drive each is provided for the comminution cylinder and the sieve device.

10. The comminution device according to claim 1, wherein the comminution cylinder has an electric drive.

11. The comminution device according to claim 1, wherein the sieve device has a hydraulic drive.

12. The comminution device according to claim 1, wherein a relative movement of the sieve is provided and a length or a dimension of the relative movement of the sieve device changes, and corresponds at least with a distance at which the comminution tools are arranged on the comminution cylinder.

13. The comminution device according to claim 1, wherein a position of the comminution cylinders in the device is orientated essentially horizontally.

14. The comminution device according to claim 1, wherein the sieve device embraces the comminution cylinder in a bottom region in a direction of installation.

15. The comminution device according to claim 1, wherein the sieve device embraces the comminution cylinder by about 45 to 60 percent in section.

16. The comminution device according to claim 1, wherein a bottom end of the sieve device and a top section form an angle of 40 to 60 degrees with regard to a positioning level of the device.

* * * * *